US010865654B2

(12) United States Patent
Hafner et al.

(10) Patent No.: US 10,865,654 B2
(45) Date of Patent: Dec. 15, 2020

(54) TURBINE SHROUD ASSEMBLY

(71) Applicant: GENERAL ELECTRIC COMPANY, Schenectady, NY (US)

(72) Inventors: Matthew Troy Hafner, Honea Path, SC (US); Frederic Woodrow Roberts, Jr., Simpsonville, SC (US); Glenn Curtis Taxacher, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 335 days.

(21) Appl. No.: 15/623,657

(22) Filed: Jun. 15, 2017

(65) Prior Publication Data

US 2018/0363485 A1 Dec. 20, 2018

(51) Int. Cl.

| | |
|---|---|
| ***F01D 11/00*** | (2006.01) |
| ***F01D 9/04*** | (2006.01) |
| ***F01D 11/08*** | (2006.01) |

(52) U.S. Cl.

CPC ..... *F01D 11/005* (2013.01); *F01D 9/04* (2013.01); *F01D 11/08* (2013.01); *F05D 2220/32* (2013.01); *F05D 2240/11* (2013.01); *F05D 2300/175* (2013.01); *F05D 2300/6033* (2013.01)

(58) Field of Classification Search

None

See application file for complete search history.

(56) References Cited

U.S. PATENT DOCUMENTS

| | | | | |
|---|---|---|---|---|
| 5,167,485 | A * | 12/1992 | Starkweather | F01D 11/005 415/115 |
| 5,188,507 | A | 2/1993 | Sweeney | |
| 6,113,349 | A * | 9/2000 | Bagepalli | F01D 11/08 415/135 |
| 6,315,519 | B1 * | 11/2001 | Bagepalli | F01D 11/08 415/135 |
| 6,893,214 | B2 * | 5/2005 | Alford | F01D 9/04 415/138 |
| 8,905,709 | B2 * | 12/2014 | Dziech | F01D 11/005 415/173.1 |
| 9,416,675 | B2 * | 8/2016 | Lacy | F01D 11/005 |

(Continued)

*Primary Examiner* — Kenneth J Hansen

*Assistant Examiner* — Jason Fountain

(74) *Attorney, Agent, or Firm* — McNees Wallace & Nurick LLC

(57) ABSTRACT

A turbine shroud assembly including an outer shroud arranged within a turbine and further comprising opposed extending portions. The turbine shroud assembly further including an inner shroud shielding the outer shroud from a gas flowing along a gas path within the turbine during operation of the turbine and comprising opposed first and second arcuate portions extending around and in direct contact with a corresponding extending portion of the outer shroud for supporting the inner shroud from the outer shroud. The turbine shroud assembly further including a spline seal extending between the first and second arcuate portions and positioned between the inner shroud and the outer shroud. The turbine shroud assembly further including at least one of the inner shroud, the outer shroud and the spline seal including at least one protrusion for maintaining positive retention of the spline seal during non-operation of the turbine.

18 Claims, 7 Drawing Sheets

(56) References Cited

U.S. PATENT DOCUMENTS

2012/0082540 A1* 4/2012 Dziech ..... F01D 11/005
415/173.1
2015/0211377 A1* 7/2015 Lacy ..... F16J 15/02
277/590

* cited by examiner

TURBINE SHROUD ASSEMBLY

FIELD OF THE INVENTION

The present invention is directed to turbine shroud assemblies. More particularly, the present invention is directed to turbine shroud assemblies having spline seals.

BACKGROUND OF THE INVENTION

Hot gas path components of gas turbines, which include metal and ceramic matrix composite ("CMC") components that are positioned adjacent to each other, are subjected to elevated temperatures and harsh environments during operation. For example, turbine shrouds include a hot gas path-facing sub-component which is not fully secured to, but in contact with, a non-hot gas path-facing sub-component. These sub-components have different rates of thermal expansion, and utilize a spline seal that is positioned between these sub-components to maintain a seal during gas turbine operation. However, during non-operation of the gas turbine, with sub-components returning to ambient temperatures, the spline seal is susceptible to a loss of positive retention between the sub-components, possibly resulting in inadvertent removal from the gas turbine.

BRIEF DESCRIPTION OF THE INVENTION

In an exemplary embodiment, a turbine shroud assembly includes an outer shroud arranged within a turbine and further comprising opposed extending portions. The turbine shroud assembly further includes an inner shroud shielding the outer shroud from a gas flowing along a gas path within the turbine during operation of the turbine and comprising opposed first and second arcuate portions extending around and in direct contact with a corresponding extending portion of the outer shroud for supporting the inner shroud from the outer shroud. The turbine shroud assembly further includes a spline seal extending between the first and second arcuate portions and positioned between the inner shroud and the outer shroud. The turbine shroud assembly further includes at least one of the inner shroud, the outer shroud and the spline seal including at least one protrusion for maintaining positive retention of the spline seal during non-operation of the turbine.

In another exemplary embodiment, a turbine shroud assembly includes an outer shroud arranged within a turbine and further comprising opposed extending portions, and an inner shroud shielding the outer shroud from a gas flowing along a gas path within the turbine during operation of the turbine and comprising opposed first and second arcuate portions extending around and in direct contact with a corresponding extending portion of the outer shroud for supporting the inner shroud from the outer shroud. The turbine shroud assembly further includes a length of a spline seal extending between the first and second arcuate portions and positioned between the inner shroud and the outer shroud. The outer shroud includes a first outer shroud segment and a second outer shroud segment having respective first and second outer shroud segment surfaces facing each other and separated by an outer shroud gap. The inner shroud includes a first inner shroud segment and a second inner shroud segment having respective first and second inner shroud segment surfaces facing each other and separated by an inner shroud gap. The first inner shroud segment includes a first recess portion at the first inner shroud segment surface. The second inner shroud segment includes a second recess portion at the second inner shroud segment surface, the first recess portion and the second recess portion forming a recess for receiving a width of the spline seal. The width of the spline seal spans the outer shroud gap and the inner shroud gap, the width of the spline seal having opposed edges facing corresponding surfaces of the recess. At least one of the first outer shroud near the first outer shroud surface and the spline seal include at least one first protrusion. At least one of the second outer shroud near the second outer shroud surface and the spline seal include at least one second protrusion, and the at least one first protrusion and the at least one second protrusion maintaining positive retention of the spline seal during non-operation of the turbine.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are exemplary turbine components, such spline seals and turbine shroud assemblies. Embodiments of the present disclosure, in comparison to articles not utilizing one or more features disclosed herein, increase component life, decrease maintenance requirements, decrease cost, improve sealing or combinations thereof.

Figure 1:
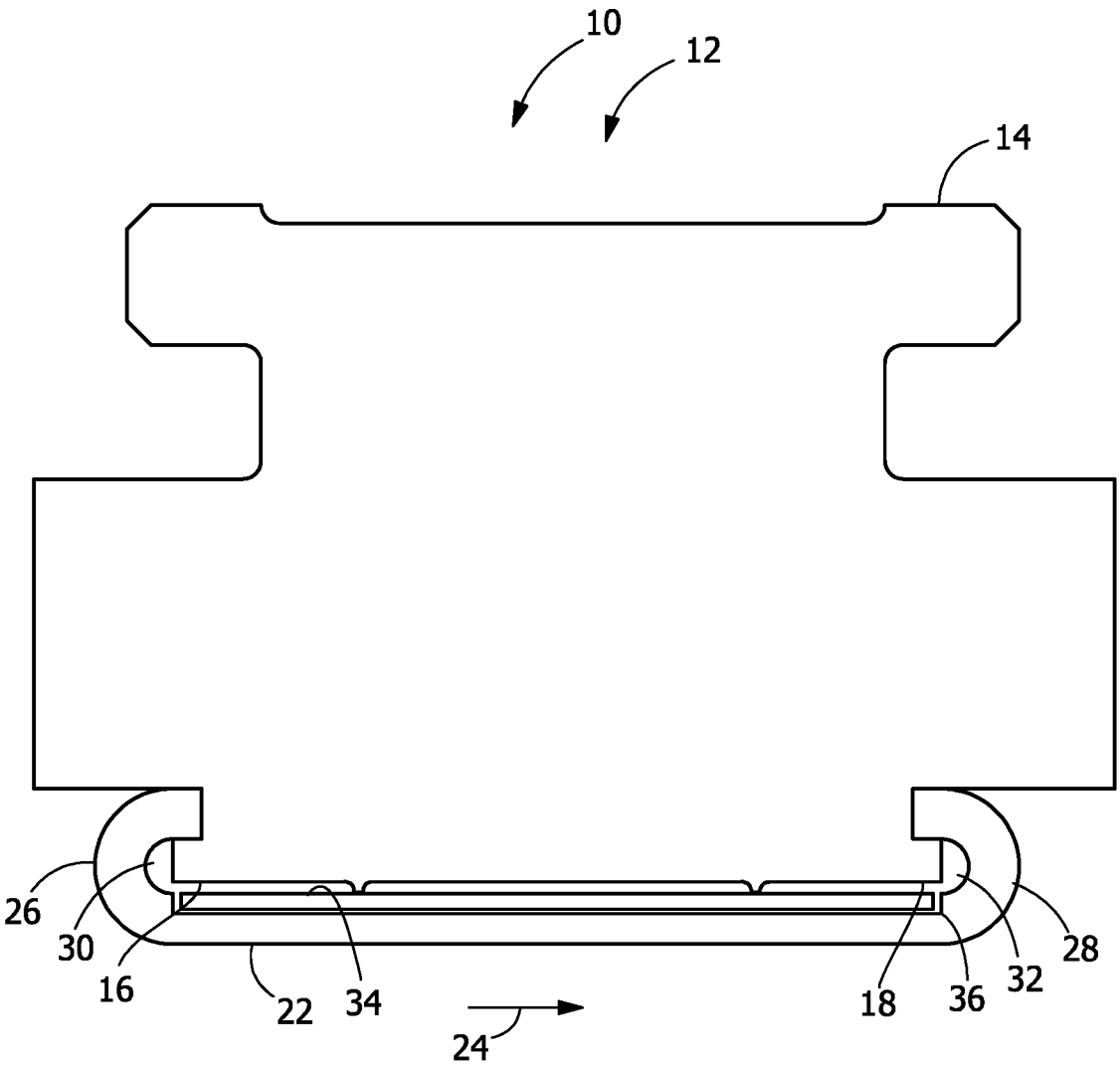
FIG. 1 is an elevation view of an exemplary shroud assembly, according to an embodiment of the present disclosure.

Referring to FIG. 1, a gas turbine 10 includes a turbine assembly or shroud assembly 12 having an outer shroud 14 arranged within the gas turbine. Outer shroud 14 includes opposed extending portions 16, 18 or an upstream edge or portion 16 and an opposed downstream edge or portion 18 extending along a circumferential length. An inner shroud 22 extends along a circumferential length adjacent outer shroud 14 and shields the outer shroud from a hot gas 24 flowing along a hot gas path within gas turbine 10 during operation. Inner shroud 22 comprises an arcuate portion or arcuate upstream portion 26 defining an upstream slot 30 for receiving in direct contact upstream edge or portion 16 of outer shroud 14, and an arcuate portion or arcuate downstream portion 28 defining a downstream slot 32 for receiving in direct contact downstream edge or portion 18 of outer shroud 14. A spline seal 34 is positioned in a slot 36 between inner shroud 22 and outer shroud 14 and extends between arcuate portions 26, 28, as will be discussed in further detail below.

Figure 2:
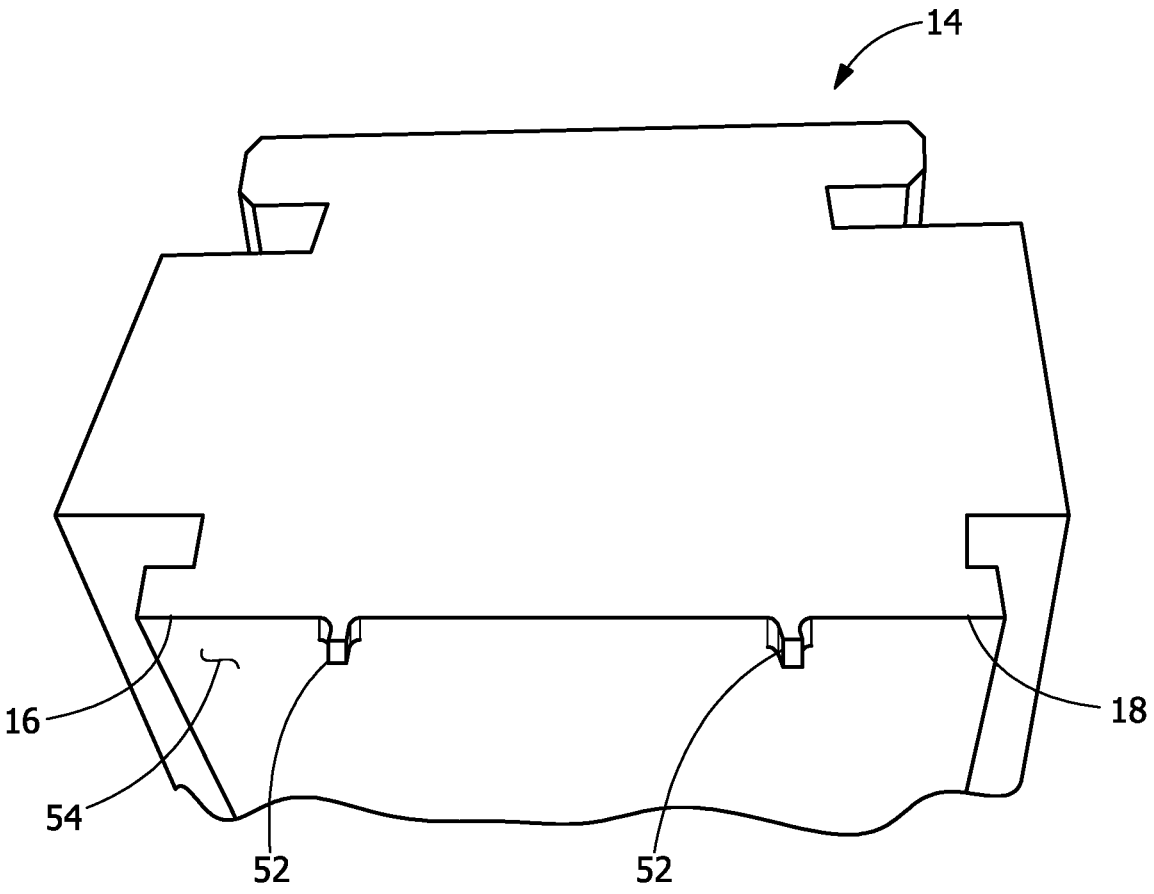
FIG. 2 is a lower perspective view of an exemplary outer shroud, according to the present disclosure.
Figure 3:
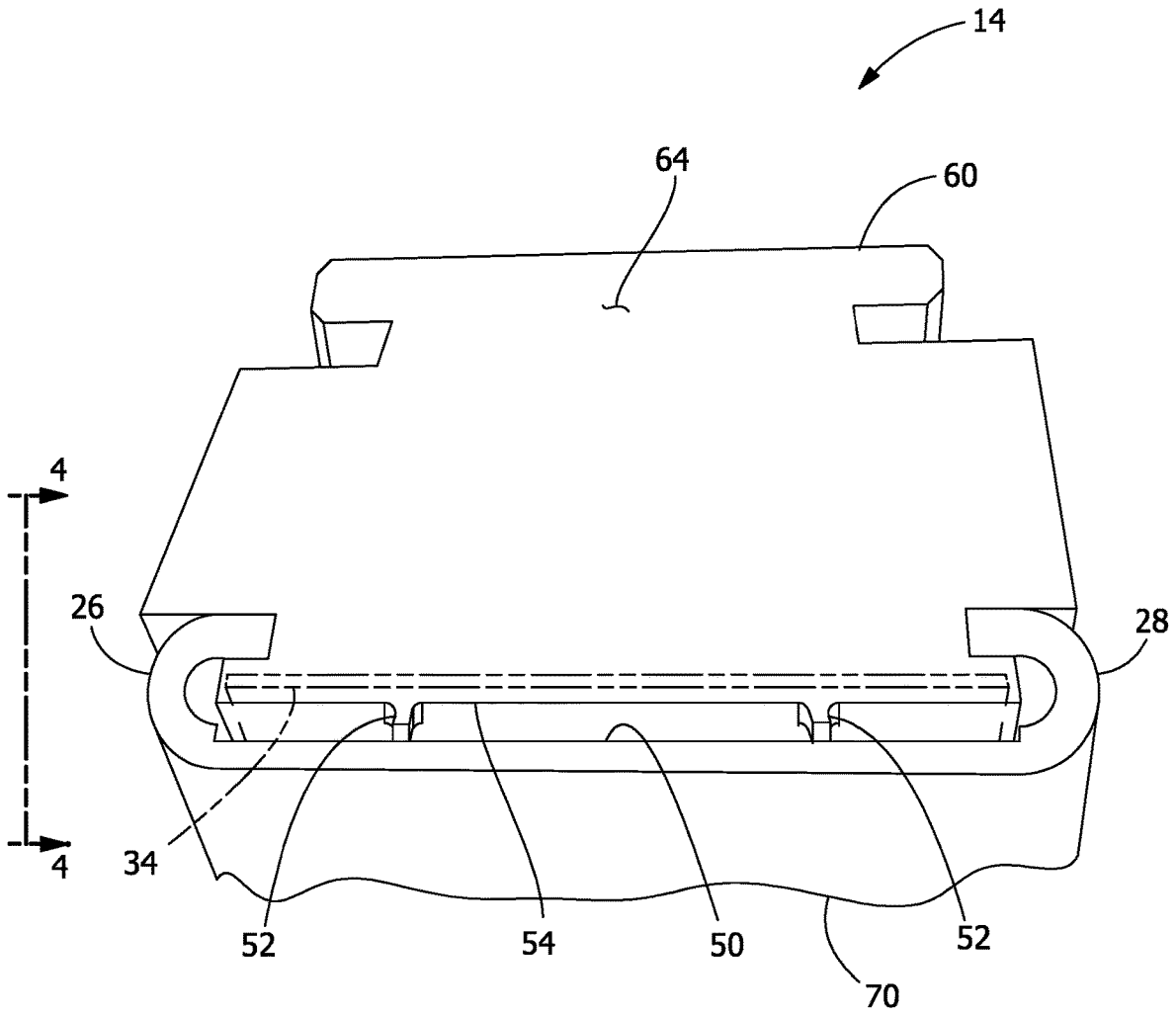
FIG. 3 is a lower perspective view of an exemplary inner and outer shroud and a spline seal, according to the present disclosure.

FIG. 2, which is a lower perspective view of an exemplary outer shroud 14, shows a pair of protrusions 52 extending away from a surface 54 of the outer shroud. As shown in FIG. 3, which is a lower perspective view of exemplary inner and outer shrouds 22, 14, spline seal 34 is positioned between surface 54 of outer shroud 14 and a corresponding facing surface 50 of inner shroud 22. However, due to protrusions 52 extending from surface 54 toward spline seal 34, decreasing the spacing between spline seal 34 and surface 50 of inner shroud 22 facing the spline seal, the spline seal is positively retained during both during operation and non-operation of gas turbine 10 (FIG. 1), as will be discussed in further detail below. In one embodiment, at least one protrusion 52 (e.g., protrusion arrangement of FIG. 5) may positively retain spline seal 34 during both operation and non-operation of gas turbine 10.

Figure 4:
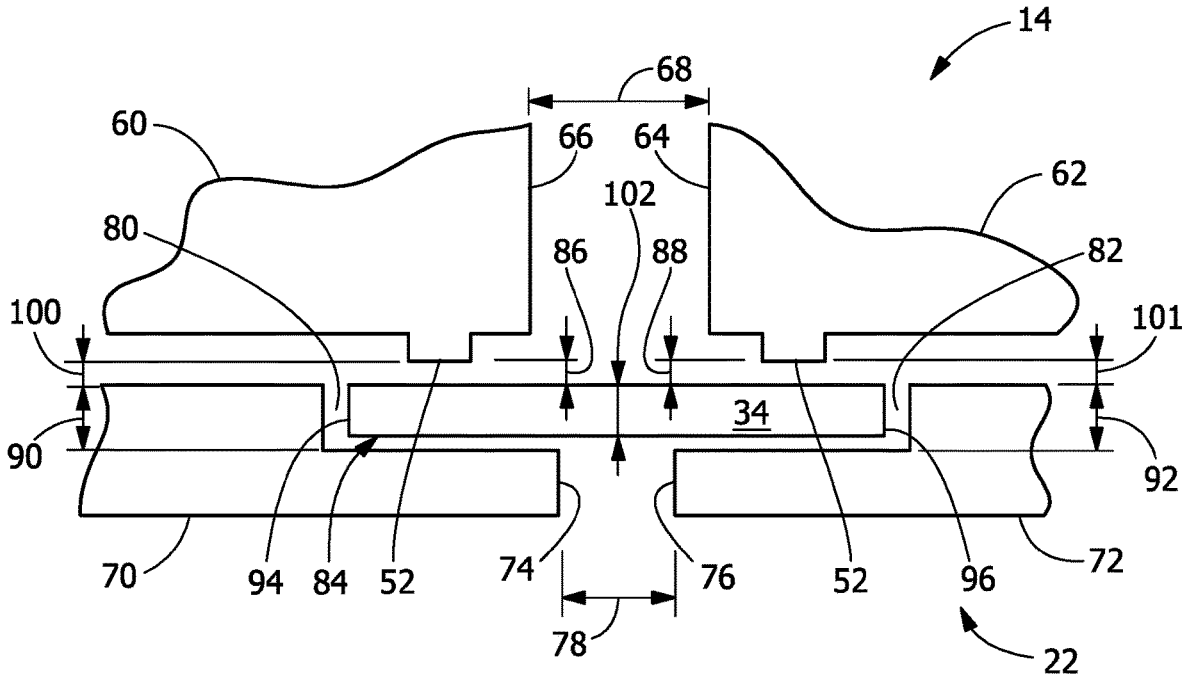
FIG. 4 is an enlarged, partial elevation view of exemplary adjacent inner and outer shroud segments and a spline seal taken along line 4-4 of FIG. 3, according to the present disclosure.

FIG. 4, which is an enlarged, partial elevation view of exemplary adjacent inner and outer shroud segments and a spline seal taken along line 4-4 of FIG. 3, is now discussed. Line 4-4 of FIG. 4 shows the interface between adjacent shroud segments. As shown, outer shroud 14 includes outer shroud segments 60, 62, and inner shroud 22 includes inner shroud segments 70, 72. Outer shroud segments 60, 62 include respective outer shroud segment surfaces 64, 66 separated by an outer shroud gap 68. A protrusion 52 extends from outer shroud segment 60 toward inner shroud segment 70, and another protrusion 52 extends from outer shroud segment 62 toward inner shroud segment 72.

Figure 9:
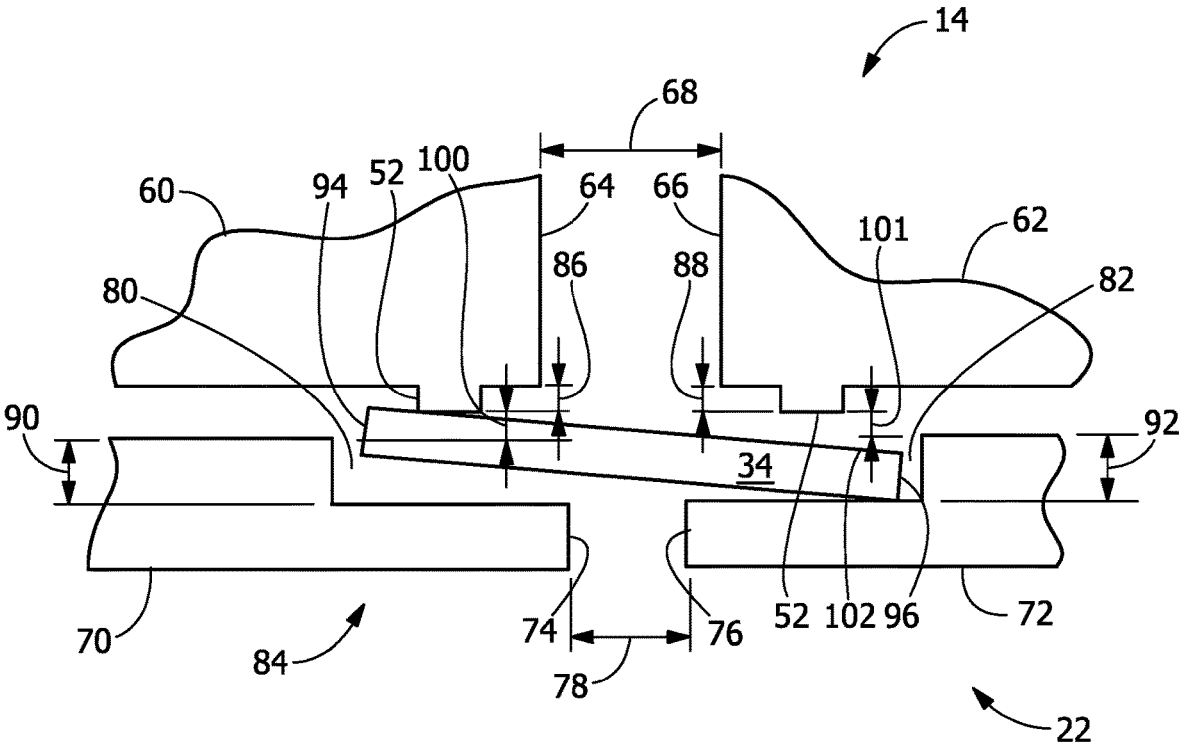
FIG. 9 is an enlarged, partial elevation view of exemplary adjacent inner and outer shroud segments and a spline seal, according to the present disclosure.

As further shown in FIG. 4, inner shroud segments 70, 72 include respective inner shroud segment surfaces 74, 76 separated by an inner shroud gap 78. Inner shroud segments 70, 72 further include respective recess portions 80, 82 positioned at inner shroud segment surfaces 74, 76, which recess portions collectively forming a recess 84 for receiving spline seal 34. That is, opposed edges 94, 96 of the width of spline seal 34 face corresponding surfaces of recess 84. As shown, recess portion 80 has a depth 90, and recess portion 82 has a depth 92. In one embodiment, depths 90, 92 are the same. As shown, with a width of spline seal 34 positioned in recess 84 and spanning outer shroud gap 68 and inner shroud gap 78, protrusion 52 extends from outer segment 60 toward a corresponding surface of the spline seal and is separated by a predetermined gap 86, and another protrusion 52 extends from outer segment 62 toward a corresponding surface of the spline seal and is separated by a predetermined gap 88. In one embodiment, gaps 100, 101 between protrusions 52 and respective facing surfaces of inner shroud segments 70, 72 are the same. During non-operation of gas turbine (FIG. 1), which for purposes herein means that gas turbine components have had sufficient time to approach an ambient temperature surrounding the gas turbine components, as a result of the differences in rates of thermal contraction, gaps 100, 101 are greater than zero. In one embodiment, gaps 100, 101 are approximately 0.03 inch during non-operation of the gas turbine. However, while gaps 100, 101 are greater than zero, these gaps are less than the thickness 102 of seal 34. That is, as shown in FIG. 9, protrusions 52 are sized to ensure that gaps 100, 101 are less than the thickness 102 of the seal 34 during non-operation of the gas turbine, thereby preventing inadvertent release of the spline seal 34, or maintaining positive retention of the spline seal in the gas turbine during non-operation of the gas turbine.

Figure 6:
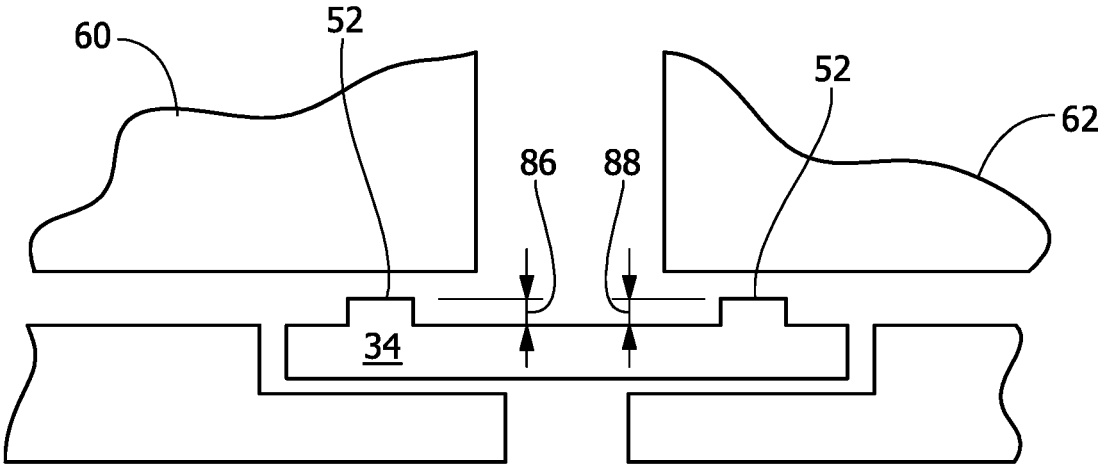
FIG. 6 is an enlarged, partial elevation view of exemplary adjacent inner and outer shroud segments and a spline seal, according to the present disclosure.
Figure 7:
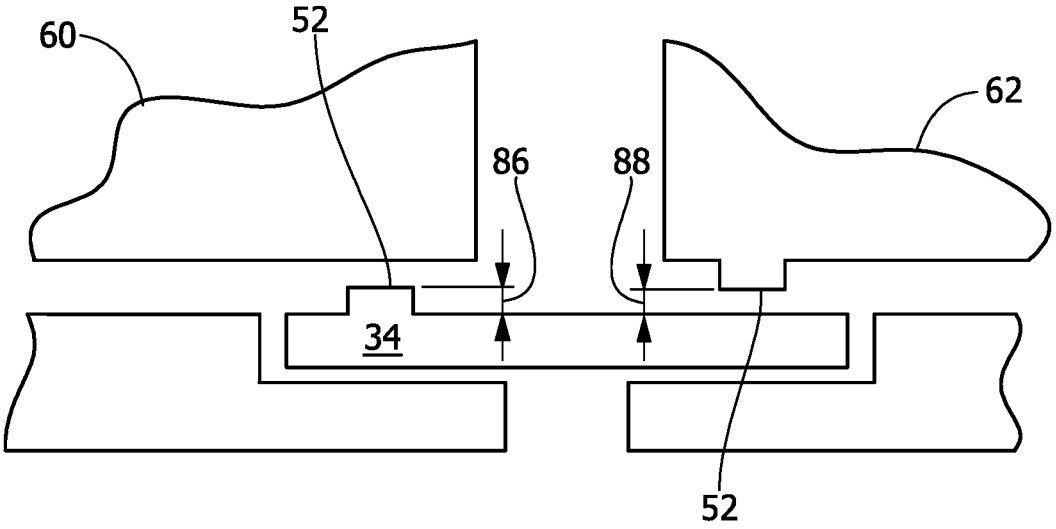
FIG. 7 is an enlarged, partial elevation view of exemplary adjacent inner and outer shroud segments and a spline seal, according to the present disclosure.
Figure 8:
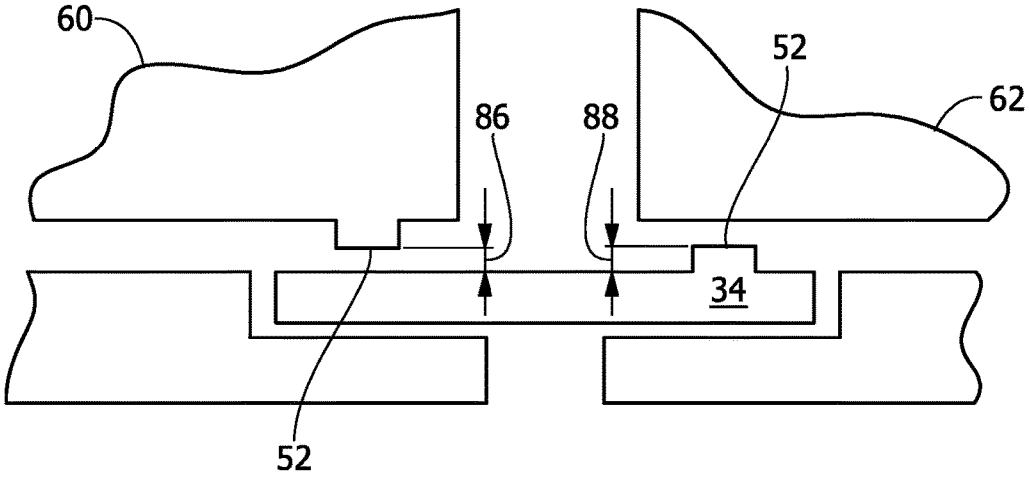
FIG. 8 is an enlarged, partial elevation view of exemplary adjacent inner and outer shroud segments and a spline seal, according to the present disclosure.

FIGS. 6, 7 and 8 show different embodiments of protrusions 52 extending from one or more of outer shroud segments 60, 62 and spline seal 34.

Figure 5:
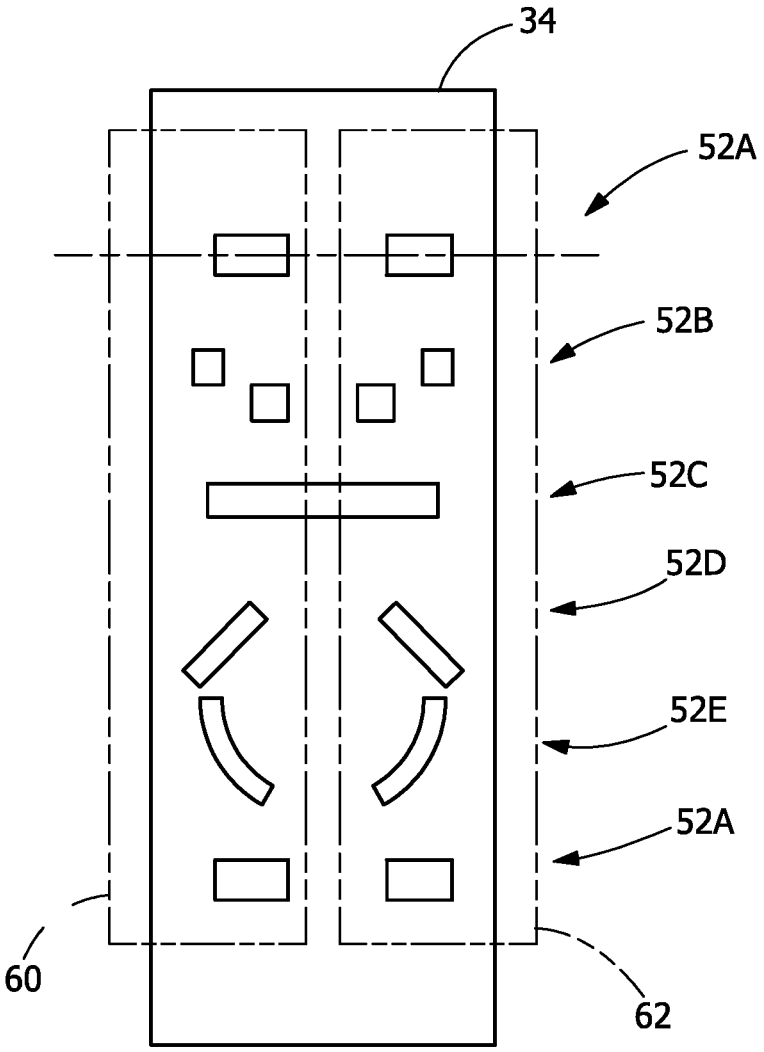
FIG. 5 is a plan view of an exemplary spline seal, according to the present disclosure.

FIG. 5 shows exemplary arrangements of protrusions extending from spline seal 34, although it is appreciated these protrusion arrangements may alternately, or additionally extend from one or more of outer shroud segments 60, 62. For example, in one embodiment, each protrusion of protrusion arrangement 52A may be axially aligned. One half of protrusions 52 of the pair of protrusion arrangements 52A are shown in FIG. 3. In one embodiment, protrusion arrangement 52A is oriented perpendicular to the longitudinal length of spline seal 34. In one embodiment, protrusion arrangement 52B may be discontinuous. In one embodiment, protrusion arrangement 52C is continuous and forms a single piece. In one embodiment, such as protrusion arrangement 52C, the protrusion arrangement is generally centered along the length or longitudinal length of the spline seal and/or inner/outer shroud segment. In one embodiment, protrusion arrangement 52D may oriented non-perpendicular to the longitudinal length of spline seal 34. In one embodiment, one or more of protrusions of protrusion arrangement 52E may be curved. In one embodiment, one or more protrusions of a protrusion arrangement may be non-symmetrical. In one embodiment, the protrusion arrangement may be any combination or sub-combination as desired or appropriate. In one embodiment, one or more protrusions or portions of protrusion(s) may extend a different length from a surface of a respective inner or outer shroud segment or spline seal, as appropriate, so long as the protrusion(s) function in a manner consistent with that previously discussed in the present disclosure.

Spline seal 34 (FIG. 4) may include any suitable material, including, but not limited to, a nickel-based superalloy, a ceramic, HAYNES 188, or a combination thereof.

Inner shroud 22 may include any suitable material composition, including, but not limited to, CMC material such as, but not limited to, aluminum oxide-fiber-reinforced aluminum oxides (Ox/Ox), carbon-fiber-reinforced silicon carbides (C/SiC), silicon-carbide-fiber-reinforced silicon carbides (SiC/SiC), carbon-fiber-reinforced silicon nitrides (C/Si3N4), or silicon-carbide-fiber-reinforced silicon nitrides (SiC/Si3N4), or superalloy material, such as, but not limited to, nickel-based superalloys, cobalt-based superalloys, René 108, René N5, INCONEL 738 or combinations thereof.

As used herein, "INCONEL 738" refers to an alloy including a composition, by weight, of about 0.17% carbon, about 16% chromium, about 8.5% cobalt, about 1.75% molybdenum, about 2.6% tungsten, about 3.4% titanium, about 3.4% aluminum, about 0.1% zirconium, about 2% niobium, and a balance of nickel.

As used herein, "HAYNES 188" refers to an alloy including a composition, by weight, of about 22% chromium, about 22% nickel, about 0.1% carbon, about 3% iron, about 1.25% manganese, about 0.35% silicon, about 14% tungsten, about 0.03% lanthanum, and a balance of cobalt.

As used herein, "René N5" refers to an alloy including a composition, by weight, of about 7.5% cobalt, about 7.0% chromium, about 6.5% tantalum, about 6.2% aluminum, about 5.0% tungsten, about 3.0% rhenium, about 1.5% molybdenum, about 0.15% hafnium, and a balance of nickel.

As used herein, "René 108" refers to an alloy including a composition, by weight, of about 8.4% chromium, about 9.5% cobalt, about 5.5% aluminum, about 0.7% titanium, about 9.5% tungsten, about 0.5% molybdenum, about 3% tantalum, about 1.5% hafnium, and a balance of nickel.

Outer shroud 14 may include any suitable material composition, including, but not limited to, iron alloys, steels, stainless steels, carbon steels, nickel alloys, superalloys, nickel-based superalloys, cobalt-based superalloys, or combinations thereof.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A turbine shroud assembly comprising:

an outer shroud arranged within a turbine and further comprising opposed extending portions;

an inner shroud shielding the outer shroud from a gas flowing along a gas path within the turbine during operation of the turbine and comprising opposed first and second arcuate portions extending around and in direct contact with a corresponding extending portion of the outer shroud for supporting the inner shroud from the outer shroud;

a spline seal having a length extending between the first and second arcuate portions, a thickness extending between the inner shroud and the outer shroud, and a width extending between opposed edges of the spline seal perpendicular to the length and the width of the spline seal, the spline seal being positioned between the inner shroud and the outer shroud; and at least one of the inner shroud, the outer shroud, and the spline seal including at least one protrusion disposed between the opposed edges of the spline seal and extending from the spline seal toward the outer shroud, from the spline seal toward the inner shroud, from the inner shroud toward the spline seal, or from the outer shroud toward the spline seal for maintaining positive retention of the spline seal during non-operation of the turbine, wherein the inner shroud has a recess which receives the spline seal.

2. The turbine shroud assembly of claim 1, wherein the at least one protrusion is continuous.

3. The turbine shroud assembly of claim 1, wherein the at least one protrusion is generally centered along the length of the spline seal.

4. The turbine shroud assembly of claim 1, wherein:

the outer shroud comprises a first outer shroud segment and a second outer shroud segment having respective first and second outer shroud segment surfaces facing each other and separated by an outer shroud gap;

the inner shroud comprises a first inner shroud segment and a second inner shroud segment having respective first and second inner shroud segment surfaces facing each other and separated by an inner shroud gap;

the first inner shroud segment includes a first recess portion at the first inner shroud segment surface;

the second inner shroud segment includes a second recess portion at the second inner shroud segment surface;

the first recess portion and the second recess portion form the recess for receiving the spline seal;

the width of the spline seal spans the outer shroud gap and the inner shroud gap, the opposed edges of the spline seal facing corresponding surfaces of the recess;

the at least one protrusion includes at least one first protrusion and at least one second protrusion;

at least one of the first outer shroud segment near the first outer shroud segment surface and the spline seal includes the at least one first protrusion;

at least one of the second outer shroud segment near the second outer shroud segment surface and the spline seal includes the at least one second protrusion.

5. The turbine shroud assembly of claim 4, wherein the at least one first protrusion and the at least one second protrusion of the spline seal define a single, continuous protrusion.

6. The turbine shroud assembly of claim 4, wherein:

the at least one first protrusion is separated from a corresponding surface of one of the spline seal and the first outer shroud segment by a first predetermined gap;

the at least one second protrusion is separated from a corresponding surface of one of the spline seal and the second outer shroud segment by a second predetermined gap; and each of the first predetermined gap and the second predetermined gap is less than the thickness of the spline seal.

7. The turbine shroud assembly of claim 6, wherein each of the first predetermined gap and the second predetermined gap is approximately 0.03 inch.

8. The turbine shroud assembly of claim 1, wherein the spline seal includes a material composition selected from the group consisting of:

a nickel-based superalloy;

a ceramic;

a composition by weight, of 22% chromium, 22% nickel, 0.1% carbon, 3% iron, 1.25% manganese, 0.35% silicon, 14% tungsten, 0.03% lanthanum, and a balance of cobalt; and combinations thereof.

9. The turbine shroud assembly of claim 1, wherein the inner shroud includes a composition selected from the group consisting of:

ceramic matrix composites (CMC);

aluminum oxide-fiber-reinforced aluminum oxides (Ox/Ox);

carbon-fiber-reinforced silicon carbides (C/SiC);

silicon-carbide-fiber-reinforced silicon carbides (SiC/SiC);

carbon-fiber-reinforced silicon nitrides (C/Si3N4);

silicon-carbide-fiber-reinforced silicon nitrides (SiC/Si3N4);

superalloys;

nickel-based superalloys;

cobalt-based superalloys;

a composition, by weight, of 8.4% chromium, 9.5% cobalt, 5.5% aluminum, 0.7% titanium, 9.5% tungsten, 0.5% molybdenum, 3% tantalum, 0.5% hafnium, and a balance of nickel;

a composition, by weight, of 7.5% cobalt, 7.0% chromium, 6.5% tantalum, 6.2% aluminum, 5.0% tungsten, 3.0% rhenium, 1.5% molybdenum, 0.15% hafnium, and a balance of nickel;

a composition, by weight, of 0.17% carbon, 16% chromium, 8.5% cobalt, 1.75% molybdenum, 2.6% tungsten, 3.4% titanium, 3.4% aluminum, 0.1% zirconium, about 2% niobium, and a balance of nickel; and combinations thereof.

10. The turbine shroud assembly of claim 1, wherein the outer shroud includes a composition selected from the group consisting of iron alloys, steels, stainless steels, carbon steels, nickel alloys, superalloys, nickel-based superalloys, cobalt-based superalloys, or combinations thereof.

11. A turbine shroud assembly comprising:

an outer shroud arranged within a turbine and further comprising opposed extending portions;

an inner shroud shielding the outer shroud from a gas flowing along a gas path within the turbine during operation of the turbine and comprising opposed first and second arcuate portions extending around and in direct contact with a corresponding extending portion of the outer shroud for supporting the inner shroud from the outer shroud; and a spline seal having a length extending between the first and second arcuate portions, a thickness extending between the inner shroud and the outer shroud, and a width extending between opposed edges of the spline seal perpendicular to the length and the width of the spline seal, the spline seal being positioned between the inner shroud and the outer shroud, wherein:

the outer shroud comprises a first outer shroud segment and a second outer shroud segment having respective first and second outer shroud segment surfaces facing each other and separated by an outer shroud gap;

the inner shroud comprises a first inner shroud segment and a second inner shroud segment having respective first and second inner shroud segment surfaces facing each other and separated by an inner shroud gap;

the first inner shroud segment includes a first recess portion at the first inner shroud segment surface;

the second inner shroud segment includes a second recess portion at the second inner shroud segment surface;

the first recess portion and the second recess portion form a recess for receiving the width of the spline seal;

the width of the spline seal spans the outer shroud gap and the inner shroud gap, the opposed edges of the spline seal facing corresponding surfaces of the recess;

at least one of the first outer shroud segment near the first outer shroud segment surface and the spline seal includes at least one first protrusion disposed between the opposed edges of the spline seal and extending from the spline seal toward the first outer shroud segment or from the first outer shroud segment toward the spline seal;

at least one of the second outer shroud segment near the second outer shroud segment surface and the spline seal includes at least one second protrusion disposed between the opposed edges of the spline seal and extending fromthe spline seal toward the second outer shroud segment of from the second outer shroud segment toward the spline seal; and the at least one first protrusion and the at least one second protrusion maintain positive retention of the spline seal during non-operation of the turbine.

12. The turbine shroud assembly of claim 11, wherein at least one of the at least one first protrusion and the at least one second protrusion of the spline seal define a single, continuous protrusion.

13. The turbine shroud assembly of claim 11, wherein:

the at least one first protrusion is separated from a corresponding surface of one of the spline seal and the first outer shroud segment by a first predetermined gap;

the at least one second protrusion is separated from a corresponding surface of one of the spline seal and the second outer shroud segment by a second predetermined gap; and the predetermined gap is less than the thickness of the spline seal.

14. The turbine shroud assembly of claim 13, wherein each of the first predetermined gap and the second predetermined gap is approximately 0.03 inch.

15. The turbine shroud assembly of claim 11, wherein the at least one first protrusion and the at least one second protrusion of the spline seal define a single, continuous protrusion.

16. The turbine shroud assembly of claim 11, wherein the spline seal includes a material composition selected from the group consisting of:

a nickel-based superalloy;

a ceramic;

a composition by weight, of 22% chromium, 22% nickel, 0.1% carbon, 3% iron, 1.25% manganese, 0.35% silicon, 14% tungsten, 0.03% lanthanum, and a balance of cobalt; and combinations thereof.

17. The turbine shroud assembly of claim 11, wherein the inner shroud includes a composition selected from the group consisting of:

ceramic matrix composites (CMC);

aluminum oxide-fiber-reinforced aluminum oxides (Ox/Ox);

carbon-fiber-reinforced silicon carbides (C/SiC);

silicon-carbide-fiber-reinforced silicon carbides (SiC/SiC);

carbon-fiber-reinforced silicon nitrides (C/Si3N4);

silicon-carbide-fiber-reinforced silicon nitrides (SiC/Si3N4);

superalloys;

nickel-based superalloys;

cobalt-based superalloys;

a composition, by weight, of 8.4% chromium, 9.5% cobalt, 5.5% aluminum, 0.7% titanium, 9.5% tungsten, 0.5% molybdenum, 3% tantalum, 1.5% hafnium, and a balance of nickel;

a composition, by weight, of 7.5% cobalt, 7.0% chromium, 6.5% tantalum, 6.2% aluminum, 5.0% tungsten, 3.0% rhenium, 1.5% molybdenum, 0.15% hafnium, and a balance of nickel;

a composition, by weight, of 0.17% carbon, 16% chromium, 8.5% cobalt, 1.75% molybdenum, 2.6% tungsten, 3.4% titanium, 3.4% aluminum, 0.1% zirconium, 2% niobium, and a balance of nickel; and combinations thereof.

18. The turbine shroud assembly of claim 11, wherein the outer shroud includes a composition selected from the group consisting of iron alloys, steels, stainless steels, carbon steels, nickel alloys, superalloys, nickel-based superalloys, cobalt-based superalloys, or combinations thereof.

* * * * *